US006699057B2

(12) United States Patent
Ma

(10) Patent No.: US 6,699,057 B2
(45) Date of Patent: Mar. 2, 2004

(54) LAND GRID ARRAY CONNECTOR ASSEMBLY

(75) Inventor: Hao-Yun Ma, Tu-Chen, MA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 29 days.

(21) Appl. No.: 10/447,353

(22) Filed: May 28, 2003

(65) Prior Publication Data

US 2004/0018769 A1 Jan. 29, 2004

(30) Foreign Application Priority Data

Jul. 26, 2002 (TW) ..... 91211453 A

(51) Int. Cl.[7] ..... H01R 13/625
(52) U.S. Cl. ..... 439/342
(58) Field of Search ..... 439/342, 259, 439/331

(56) References Cited

U.S. PATENT DOCUMENTS 4,504,105 A 3/1985 Barkus et al.
4,621,884 A 11/1986 Berkebile, Jr. et al.
5,302,853 A 4/1994 Volz et al.
5,344,334 A 9/1994 Laub et al.
5,640,303 A 6/1997 Hooley
6,045,370 A 4/2000 Treibergs et al.
6,244,875 B1 6/2001 McHugh et al.
6,485,320 B1 11/2002 Ma
6,527,577 B1 * 3/2003 Chen et al. ..... 439/342

* cited by examiner

*Primary Examiner*—Tho D. Ta
(74) *Attorney, Agent, or Firm*—Wei Te Chung

(57) ABSTRACT

A land grid array connector assembly (1) includes an insulative housing (2) and a securing mechanism. The securing mechanism comprises a frame (3) surrounding the housing, a pressing plate (4) movably attached to the frame, and an actuating lever (5) pivotally connected to the frame. The frame further comprises a pair of locating blocks (301). Each block has a locating slot (302) for receiving a locating portion (51) of the lever. The slot forms a slantwise groove which has a lowest portion and a highest portion. A tongue portion (303) is formed on the frame adjacent the locating block. A lower surface (3032) of the tongue portion is a continuous arc surface which can generate a pushing force to position the lever at the first and second points in the slot when the lever is at the open and closed positions respectively.

19 Claims, 7 Drawing Sheets

LAND GRID ARRAY CONNECTOR ASSEMBLY

BACKGROUND OF THE INVENTION

1. Field of the Invention

The present invention relates to the art of electrical connectors, and more particularly to a land grid array connector assembly having a securing mechanism for securing a land grid array (LGA) package therein.

2. Description of the Prior Art

A land grid array (LGA) connector is commonly used in the electronic transmission field for accommodating an LGA package therein, and establishing electrical connection between the LGA package and a substrate such as a printed circuit board (PCB) on which the connector is mounted). U.S. Pat. Nos. 5,344,334, 5,302,853, 4,682,790, 4,621,884, and 4,504,105 disclose several conventional LGA sockets. As can be seen from FIGS. 8 and 9, one kind of conventional LGA connector assembly 9 typically includes a low profile insulative housing 91 and a securing mechanism attached to the housing 91. The securing mechanism comprises a frame 92, a pressing plate 93 pivotally attached to one end beam of the frame 92 for pressing and securing the housing 91 in the frame 92, and a lever 94 movably connected to an opposite end beam of the frame 92 for generating a downward pressing force to press the pressing plate 93 toward the housing 91.

The lever 94 comprises an operation handle 942 located corresponding to a lateral beam of the frame 92, a locating portion 941 perpendicularly connecting with the handle 942, and an offset camshaft 943 integrally bending from a middle portion of the locating portion 941. The camshaft 943 is adapted to engage with a hook 931 formed at a free end of the pressing plate 93. The handle 942 can rotate relative to the frame 92 between a 0-degree-angle position in which the pressing plate 93 is at an open state with the hook 931 being free from the camshaft 943, and a 180-degree-angle position where the pressing plate 93 is at a closed state with the hook 931 being pressed and located by the camshaft 943. A pair of spaced locating blocks 921 is formed on said opposite end beam of the frame 92. The blocks 921 define a pair of locating slots 922 therein respectively, the locating slots 922 pivotably accommodating the locating portion 941 therein. Each slot 922 spans upwardly and inwardly along the block 921 from a lowest portion of the slot 922 to a highest portion of the slot 922. Ideally, when the handle 942 is at the 0-degree-angle position, the locating portion 941 should be positioned at the lowest portions of the slots 922, so that the camshaft 943 is completely free from the hook 931. Then when the handle 942 is rotated to the 180-degree-angle position, the locating portion 941 should be moved to the highest portions of the slots 922, so that the hook 931 is fully pressed and accurately located by the camshaft 943.

However, in actual use, when the handle 942 is at the 0-degree-angle position, the locating portion 941 may be displaced from the lowest portions and instead be located at intermediate positions between the lowest and highest portions. Thus, when the handle 942 is rotated from the 0-degree-angle position toward the 180-degree-angle position, the locating portion 941 slides along the slots 922 from the intermediate position, and may reach the highest portions prior to the handle 942 reaching the 180-degree-angle position. When this happens, the locating portion 941 cannot continue any further along the slot 922 since it has reached the highest portion of the slot 922, and the handle 942 is restrained from reaching the 180-degree-angle position. As a result, the camshaft 943 fails to generate sufficient downward pressing force on the hook 931, and the pressing plate 93 cannot be pressed to its correct closed state. The housing 9 is thus liable to be inaccurately and unreliably located.

An improved land grid array connector assembly which overcomes the above-mentioned shortcomings is desired.

SUMMARY OF THE INVENTION

Accordingly, an object of the present invention is to provide a land grid array connector assembly having a securing mechanism for accurately and securely retaining an LGA package onto a connector housing of the connector assembly.

Another object of the present invention is to provide a securing mechanism attached to a land grid array connector to accurately retain an LGA package in the land grid array connector.

In order to achieve the objects set forth, a land grid array connector assembly in accordance with the present invention includes an insulative housing and a securing mechanism attached to the housing. The securing mechanism comprises a frame surrounding the housing, a pressing plate movably attached to one beam of the frame, and an actuating lever pivotally attached to another opposite beam of the frame. The frame has an opening for receiving the housing therein, the lever can rotate between an open position and a closed position relate to the frame, and can generate a downward pressing force to a hook of the plate thereby locating the housing in the opening of the frame.

The frame further comprise a pair of locating blocks formed on one beam thereof, each block defines a locating slot for receiving a locating portion of the lever. The slot extends upwardly and inwardly toward the opening of the frame thereby forming a slantwise groove which has a lowest portion and a highest portion. A tongue portion is formed on the beam of the frame beside the locating block and extends in a direction substantially the same as the extending direction of the slot. A lower surface of the tongue portion is a continuous arc surface which can generate a pushing force which is adapted to keep the locating portion of the lever at the lowest portion of the slot when the lever is at an open position. Alternatively, the lower surface of the tongue also can form two continuous arcs jointed by a projection protruded from a middle portion of the surface, which can locate the locating portion of the lever either at the lowest portion or the highest portion of the slot.

Other objects, advantages and novel features of the present invention will become more apparent from the following detailed description when taken in conjunction with the accompanying drawings, in which:

DESCRIPTION OF THE PREFERRED EMBODIMENTS

Reference will now be made in detail to the preferred embodiments of the present invention.

Figure 1:
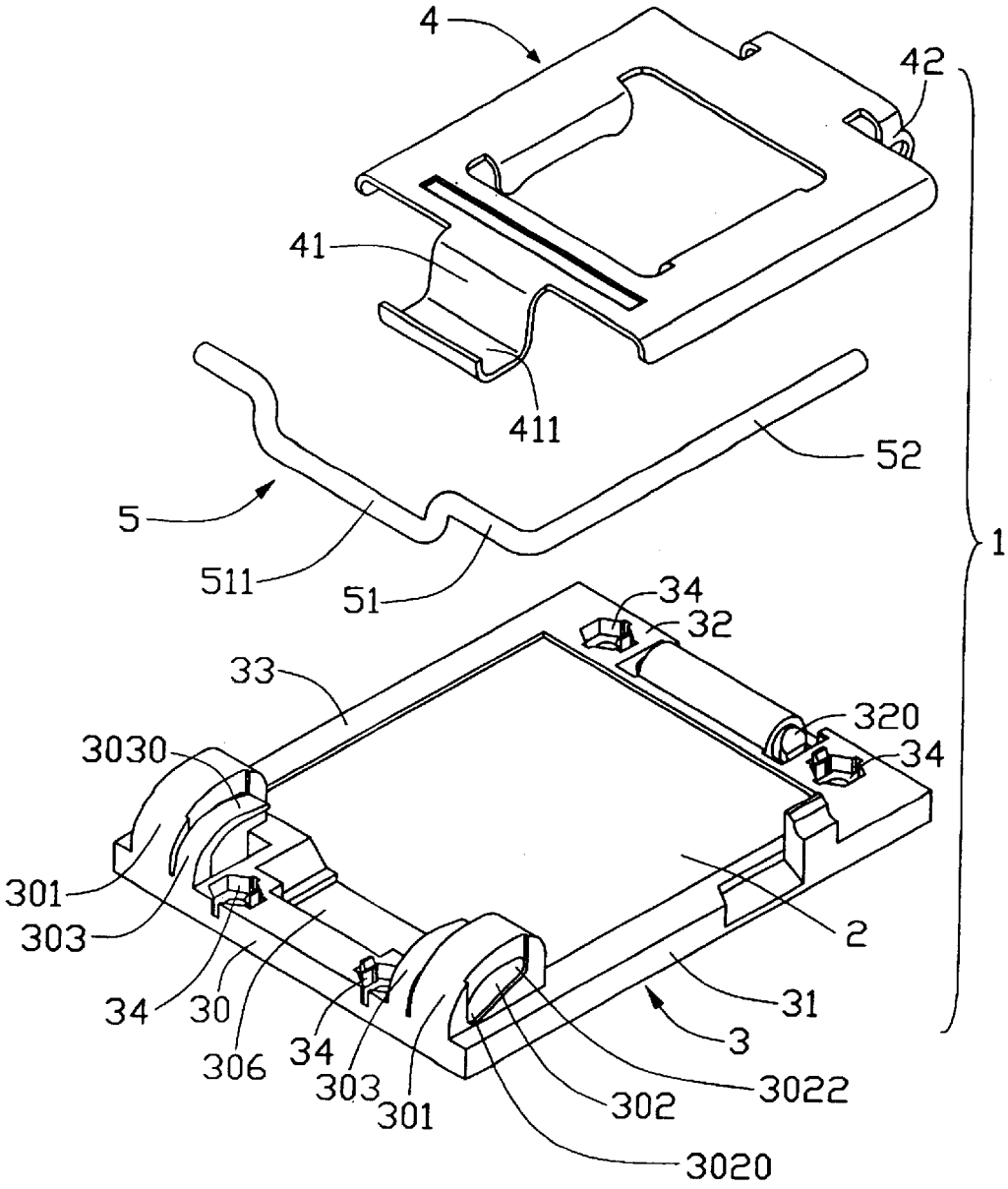
FIG. 1 is an exploded view of a land grid array connector assembly in accordance with a preferred embodiment of the present
Figure 2:
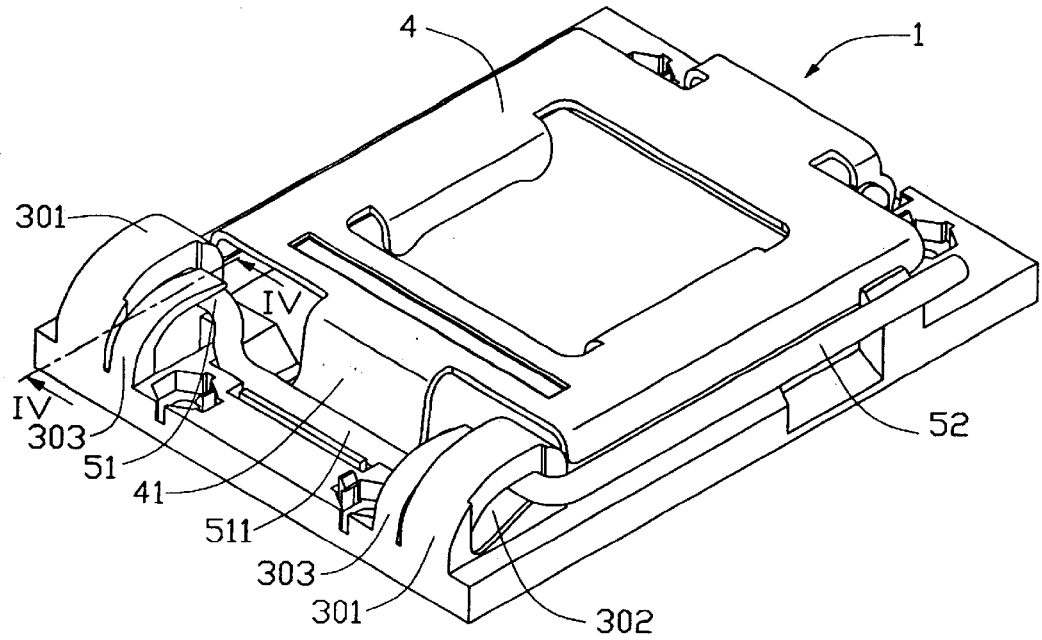
FIG. 2 is an assembled view of FIG. 1, showing the connector in a closed position.

Referring to FIGS. 1 and 2, a land grid array (LGA) connector assembly 1 in accordance with the preferred embodiment of the present invention is illustrated. The connector assembly 1 comprises an insulative housing 2 having electrical terminals (not shown in the FIGS.) received therein for electrically connecting an LGA chip to a printed circuit board (PCB, not shown in the FIGS.). The LGA chip commonly has a low profile configuration, and is pressed onto a top surface of the housing 2 thereby establishing electrical contact with the terminals of the housing 2. The connector assembly 1 further comprises a securing mechanism attached to the housing 2, for securing the housing 2 on the PCB and locating the LGA chip onto the housing 2. In the preferred embodiment, the securing mechanism includes three main elements: a frame 3, a pressing plate 4 functioning as a pressing member, and an actuating lever 5. The structures and functions of the three main elements are described in detail as follows, with reference to the corresponding FIGS.

Figure 3:
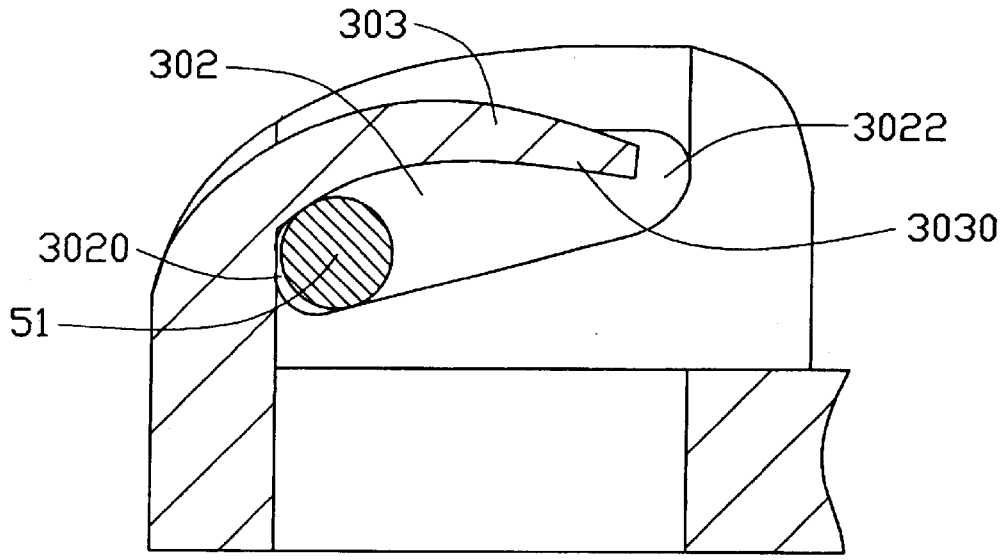
FIG. 3 is similar to FIG. 4, but showing the locating portion of the lever at a lowest portion of the slot, the connector assembly thus being in an open position.
Figure 4:
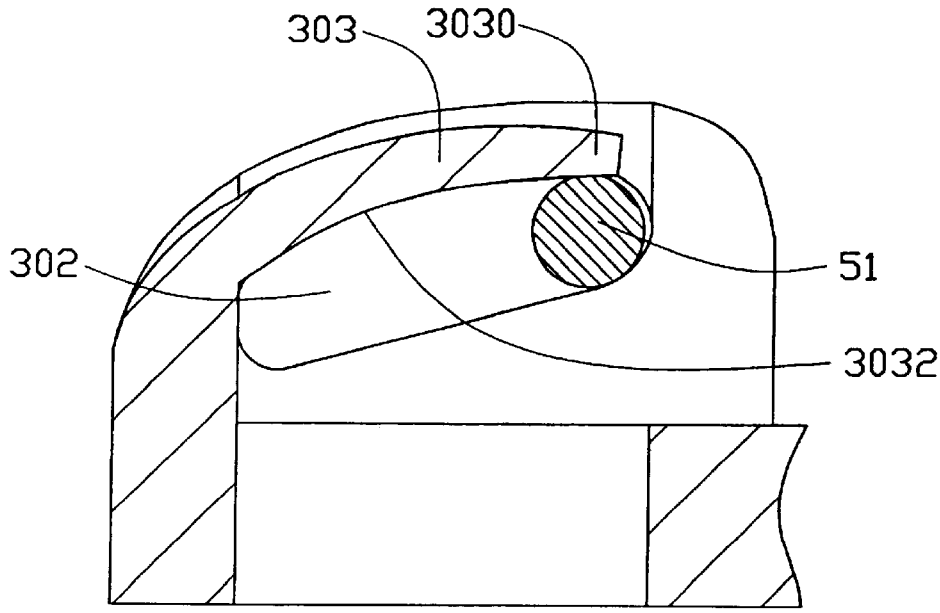
FIG. 4 is a cross-sectional view taken along line IV—IV of FIG. 2, showing a locating portion of a lever at a highest portion of a slot of a frame.

The frame 3 has a generally rectangular configuration, and includes a first beam 30, a second beam 31, a third beam 32 opposite from the first beam 30, and a fourth beam 33 opposite from the second beam 31. The four beams 30, 31, 32, 33 cooperatively define a central opening therebetween, the opening being dimensioned to fit the housing 2 therein. As can be discerned from FIGS. 1 and 2, the housing 2 has been located in the opening, and the opening is therefore not visible. The first beam 30 and the third beam 32 each define a pair of spaced locating holes 34 therein, for receiving a pair of locating pins (not shown in the FIGS.) to secure the frame 3 onto the PCB. The first beam 30 forms a pair of locating blocks 301 at junctions with the second beam 31 and the fourth beam 33 respectively. Each block 301 defines a locating slot 302 therein. The slot 302 spans inwardly and upwardly in a slantwise direction perpendicular to the first beam 30 from a lowest portion 3020 of the slot 302 to a highest portion 3022 of the slot 302. A pair of spaced tongue portions 303 is provided on the first beam 30. Each tongue portion 303 projects from a top surface of the first beam 30 between a corresponding locating hole 34 and a corresponding locating block 301, in a direction substantially the same as a direction spanned by an adjacent slot 302. Each tongue portion 303 forms a locating end 3030 at a free end thereof. Referring to FIGS. 3 and 4, in the preferred embodiment, each tongue portion 303 has a curved lower surface 3032 configured as a continuous concave arc. The function of the lower surface 3032 is described in detail below. The first beam 30 also has a notched portion at a middle thereof, the notched portion defining a recess 306 whose function is described below.

The pressing plate 4 is made of hard material. For example, the pressing plate 4 may be stamped and bent from a sheet of metal. The pressing plate 4 is movably attached to the frame 3 by securing a pair of latches 42 formed at one end of the pressing plate 4 in corresponding receiving holes 320 defined in the third beam 32 of the frame 3. The pressing plate 4 has a pressing portion 41 formed at an opposite end thereof. The pressing portion 41 has a distal hook 411, which is adapted to be located in the recess 306 of the first beam 30 when the pressing plate 4 is moved to a closed position.

The actuating lever 5 is pivotally attached to the frame 3. The actuating lever 5 includes a pair of locating portions 51 pivotally received in the slots 302 of the locating blocks 301, and an operation handle 52 perpendicularly bent from one of the locating portions 51 and located generally in alignment with the second beam 31. The handle 52 can rotate relate to the frame 3 between an open position in which the handle 52 is substantially perpendicular to the frame 3, and a closed position in which the handle 52 is substantially parallel to the frame 3. The lever 5 further includes an offset pressing portion 511 between the locating portions 51. Referring to FIG. 2, the pressing portion 511 is positioned onto the hook 411 of the pressing plate 4 to locate the hook 411 in the recess 306 of the frame 3.

Referring to FIG. 3, in use, each locating portion 51 is located at the lowest portion 3020 of a corresponding slot 302. The lever 5 is thus in an open position. In this position, the locating portion 51 only lightly contacts a base portion of an adjacent tongue portion 303, and the tongue portion 303 does not exert any pressing force on the locating portion 51. However, the locating portion 51 is liable to be subjected to a sudden unwanted external force, which may drive the locating portion 51 to slide away from the lowest portion 3020. Under these circumstances, the lower surface 3032 of the tongue portion 303 resists the locating portion 51, and generates a pressing force along a direction opposite to a direction of sliding of the locating portion 51 so as to push the locating portion 51 back to the lowest portion 3020. FIG. 4 shows the locating portion 51 having been slid to the highest portion 3022 of the slot 302. The lever 5 is thus in a closed position. In this position, the pressing portion 511 of the lever 5 has rotated to press the hook 411 of the pressing plate 4 and generate a downward pressing force toward the housing 2 for locating the housing 2. Moreover, friction force between the pressing portion 511 and the hook 411 is large enough to overcome push-back force exerted by the tongue portions 303 on the locating portions 51, thereby preventing the locating portions 51 from being pushed back to the lowest portions 3020 of the slots 302.

Figure 5:
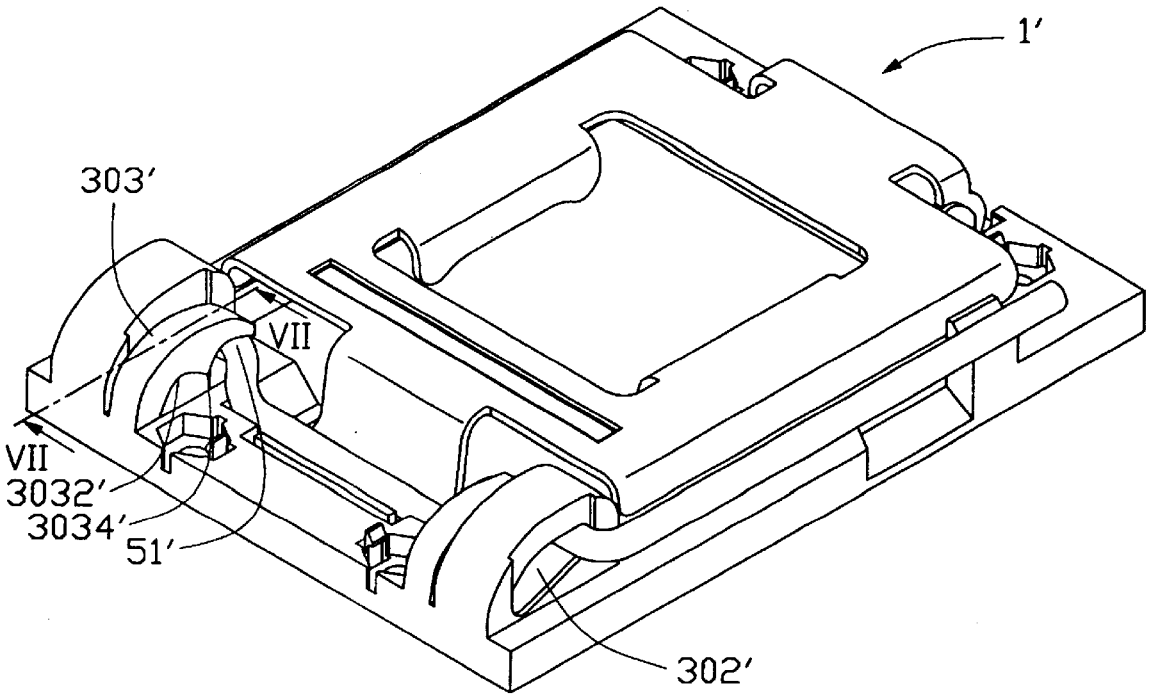
FIG. 5 is an isometric view of a land grid array connector assembly in accordance with an alternative embodiment of the present invention, showing the connector assembly in a closed position.
Figure 6:
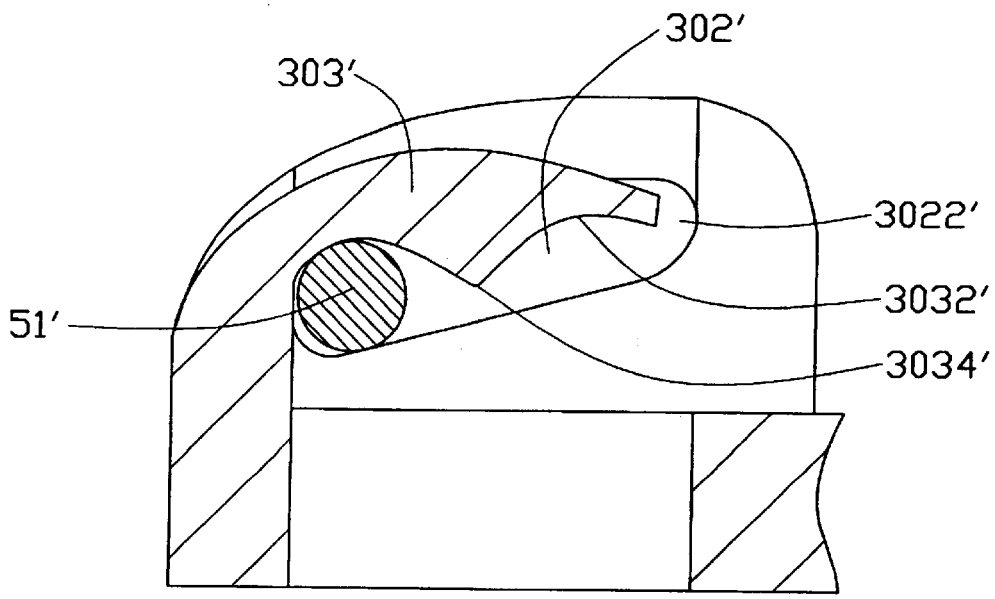
FIG. 6 is similar to FIG. 4, but showing the locating portion of the lever at a lowest portion of the slot, the connector assembly thus being in an open position.
Figure 7:
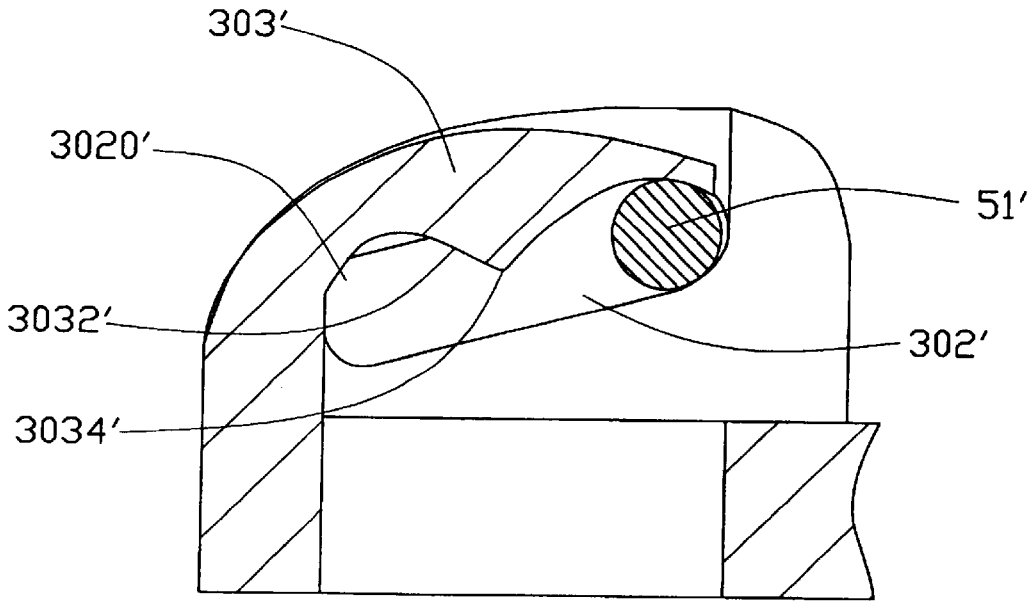
FIG. 7 is a cross-sectional taken along line VII—VI of FIG. 5, showing a locating portion of a lever at a highest portion of a slot of a frame.
Figure 8:
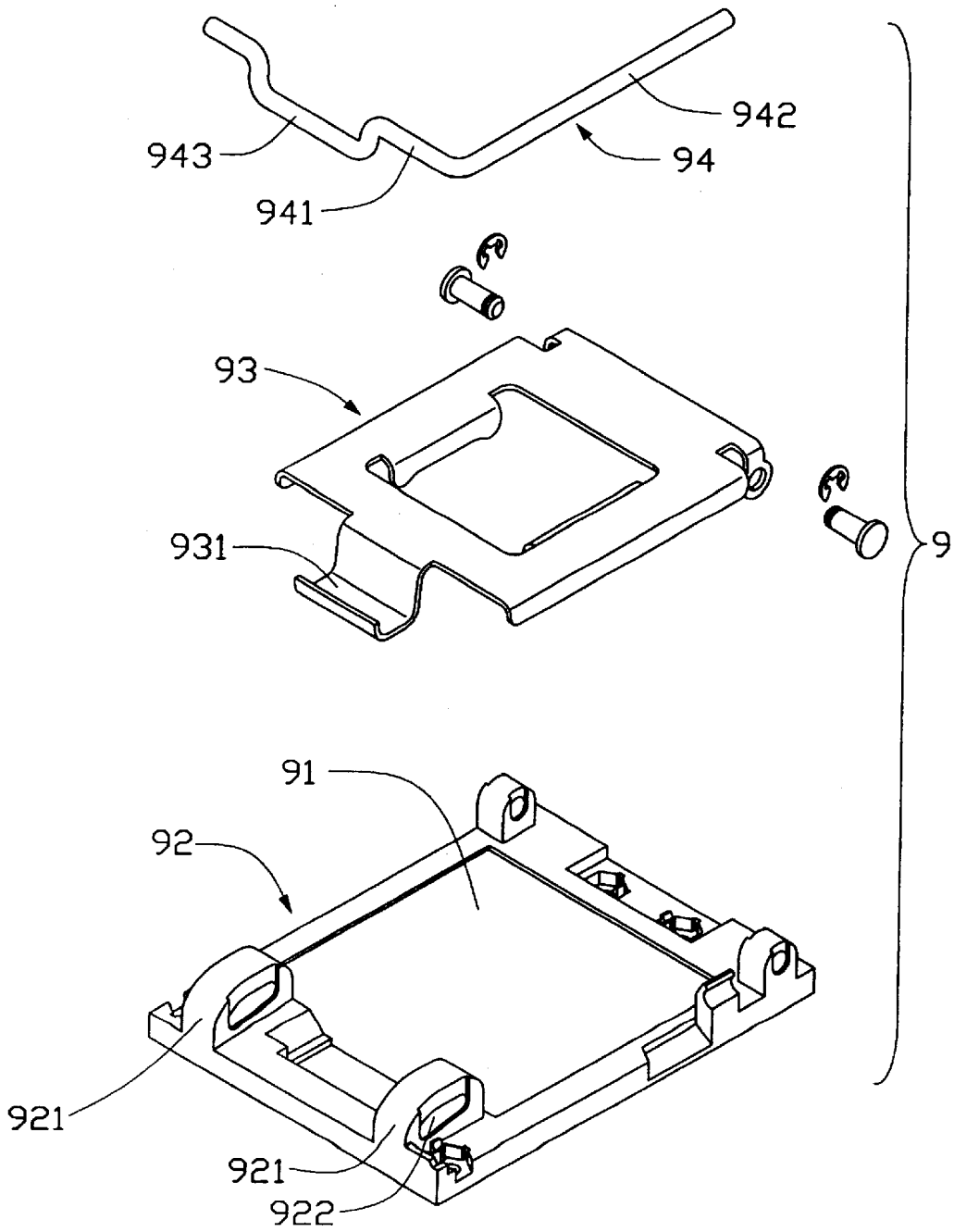
FIG. 8 (PRIOR ART)
FIG. 8 is an exploded, isometric view of a conventional land grid array connector assembly.
Figure 9:
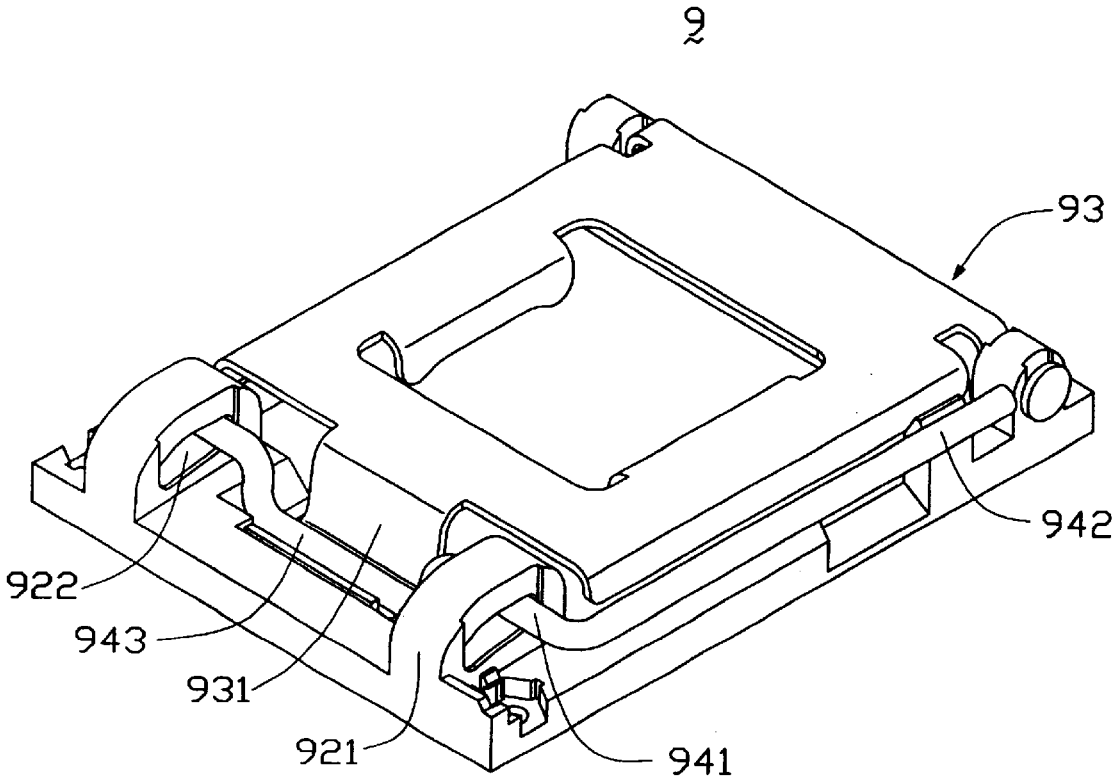
FIG. 9 (PRIOR ART)
FIG. 9 is an assembled view of FIG. 8, showing the connector assembly in a closed state.

FIGS. 5, 6 and 7 show a connector assembly 1' in accordance with the alternative embodiment of the present invention. The connector assembly 1' has substantially the same structure as the connector assembly 1 of the preferred embodiment, except for a structure and function of tongue portions 303' of the connector assembly 1'. Referring to FIG. 6, a lower surface 3032' of each tongue portion 303' comprises two contiguous concave arcs joined by a projection 3034'. That is, the lower surface 3032' comprises a lower arc and an upper arc. This feature enables a corresponding locating portion 51' to be securely positioned at either a lowest portion 3020' or a highest portion 3022' of a slot 302'. That is, after the locating portion 51' is slid to the highest portion 3022' of the slot 302', the projection 3034', in cooperation with pushing force exerted from the upper arc, prevents the locating portion 51' from sliding back from the highest portion 3022'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector assembly, comprising:

an insulative housing;

a frame adapted to support the housing, the frame having a locating block provided thereon;

a pressing plate movably attached to the frame and having a pressing portion adapted to locate the housing in the frame; and an actuating lever pivotally attached to the block;

wherein the block defines a slot, the lever slides in the slot from a lowest portion thereof in which the lever is at an open position to a highest portion thereof in which the lever is at a closed position, and a tongue portion is provided adjacent the block, the tongue portion positioning the lever at the lowest and highest portions when the lever is at the open and closed positions respectively.

2. The connector assembly as claimed in claim 1, wherein the frame comprises a first beam, a second beam adjacent the first beam, a third beam opposite from the first beam, and a fourth beam opposite from the second beam, the beam cooperatively defining an opening receiving the housing therein.

3. The connector assembly as claimed in claim 2, wherein the frame has a pair of locating blocks provided thereon at opposite ends of the first beam, the pair of blocks define a pair of slots, and each of the slots spans inwardly and upwardly in its block generally toward the opening of the frame.

4. The connector assembly as claimed in claim 3, wherein a pair of tongue portions is provided adjacent the blocks, and the tongue portions project from the first beam of the frame and extend along a direction substantially the same as a direction spanned by the slots.

5. The connector assembly as claimed in claim 4, wherein each of the tongue portions has a lower surface forming a continuous concave arc.

6. The connector assembly as claimed in claim 4, wherein the tongue portion comprises a lower surface having two contiguous concave arcs joined by a projection formed near a middle of the surface.

7. A connector assembly, comprising:

an insulative housing;

a securing mechanism securing the housing, the securing mechanism including:

a frame configured to define a space adapted to receive the housing, the frame having a locating block provided thereon, the block defining a slot extending between a first point and a second point;

a pressing member movably attached to the frame and having a pressing portion adapted to press and locate the housing in the frame; and an actuating lever positioned in the slot of the block and rotatable between an open position in which the lever is at the first point in the slot, and a closed position in which the lever is at the second point in the slot;

wherein a tongue portion is provided near the block, and the tongue portion is adapted to position the lever at the first and second points in the slot when the lever is at the open and closed positions respectively.

8. The connector assembly as claimed in claim 7, wherein the pressing member comprises a pressing plate, the pressing plate comprises the pressing portion, and the pressing portion comprises a hook adapted to press and locate the housing in the frame.

9. The connector assembly as claimed in claim 7, wherein the frame defines a central opening surrounded by four beams, thereby defining the space receiving the housing.

10. The connector assembly as claimed in claim 9, wherein the block projects from one of the beams of the frame, and the slot of the block spans between the first point and the second point in a slantwise manner, the first point being lower than the second point.

11. The connector assembly as claimed in claim 10, wherein the tongue portion has a lower surface forming a continuous concave arc extending along a direction substantially the same as a direction spanned by the slot.

12. The connector assembly as claimed in claim 10, wherein the tongue portion has a lower surface forming two contiguous concave arcs joined by a projection.

13. An electrical assembly, comprising:

a land grid array (LGA) package;

a connector having an insulative housing adapted to accommodate the LGA package and a securing mechanism adapted to pressingly secure the LGA package to the housing, the securing mechanism including:

a frame supporting the housing;

a pressing plate movably attached to the frame for pressing the housing; and an actuating lever pivotally attached to the frame and adapted to generate a pressing force to the pressing plate;

wherein a tongue portion is provided adjacent the lever, the tongue portion having at least one arcuate configuration to resiliently locate the lever at least one predetermined position.

14. The electrical assembly as claimed in claim 13, wherein the frame comprises a locating block formed thereon, and the block definines a slot spanning in a slantwise manner from a lowest point thereof to a highest point thereof, generally toward the housing.

15. The electrical assembly as claimed in claim 14, wherein the tongue is arranged adjacent the block, and extends in a direction substantially the same as a direction spanned by the slot.

16. The electrical assembly as claimed in claim 14, wherein the tongue portion has a lower surface forming a continuous concave arc, the arc being adapted to locate the lever at the lowest point of the slot when the lever is at an open position.

17. The electrical assembly as claimed in claim 14, wherein the tongue portion comprises a lower surface forming two contiguous arcs joined by a projection, the arcs being respectively adapted to locate the lever at the lowest point of the slot when the lever is at an open position, and to locate the lever at the highest point of the slot when the lever is at a closed position.

18. An electrical connector assembly comprising:

a retention frame defining opposite first and second ends thereof;

a pressing plate rotatably mounted on the first end with a distal tip extending toward the second end when said pressing plate is in a horizontal position;

an actuator including a crank structure generally rotatably mounted to the second end, said crank structure including a locating portion and a pressing portion radially offset from the locating portion and engageable with the distal tip of the pressing plate when said pressing plate is in the horizontal position and said actuator is in a locking position; and a biasing device formed on the second end to urge at least one of said locating portion and said pressing portion and to keep the pressing portion to be in an open position so as to allow the distal tip of the pressing plate to be freely rotatably moveable relative to the frame without interference with the pressing portion.

19. The assembly as claimed in claim 18, wherein said second end defines a slot, and said locating portion is received in and moveable along said slot.

* * * * *